United States Patent [19]

Kaukeinen et al.

[11] 4,258,112

[45] Mar. 24, 1981

[54] SENSITIZER FOR ELECTROPHORETIC MIGRATION IMAGING DISPERSIONS

[75] Inventors: Joseph Y. Kaukeinen; Hal E. Wright, both of Rochester, N.Y.

[73] Assignee: Eastman Kodak Company, Rochester, N.Y.

[21] Appl. No.: 953,733

[22] Filed: Oct. 23, 1978

[51] Int. Cl.[3] ..... G03G 17/04

[52] U.S. Cl. ..... 430/34; 430/32; 430/83

[58] Field of Search ..... 430/32, 34, 83

[56] References Cited

U.S. PATENT DOCUMENTS

| | | | |
|---|---|---|---|
| 3,615,416 | 10/1971 | Fox | 96/1.6 |
| 3,976,485 | 8/1976 | Groner | 96/1 PE |
| 4,078,928 | 3/1978 | Keller | 96/1 PE |

*Primary Examiner*—Edward C. Kimlin
*Assistant Examiner*—John L. Goodrow
*Attorney, Agent, or Firm*—Torger N. Dahl

[57] ABSTRACT

Compounds selected from the group consisting of (a) aromatic amines having a p-alkyl, p-alkoxy or p-alkoxycarbonyl substituent on the aromatic group, (b) aromatic alkanes, isoalkanes and cycloalkanes, having at least two aromatic groups with at least one aromatic group having an amino substituent, (c) dialkylarylamines having a pyranylalkenyl, a quinolinylalkenyl or a arylazo substituent on the aryl group, (d) a julolidine and (e) a isobenzofuran are useful as sensitizers in electrophoretic migration imaging dispersions and processes.

9 Claims, 1 Drawing Figure

SENSITIZER FOR ELECTROPHORETIC MIGRATION IMAGING DISPERSIONS

FIELD OF THE INVENTION

Figure 1:
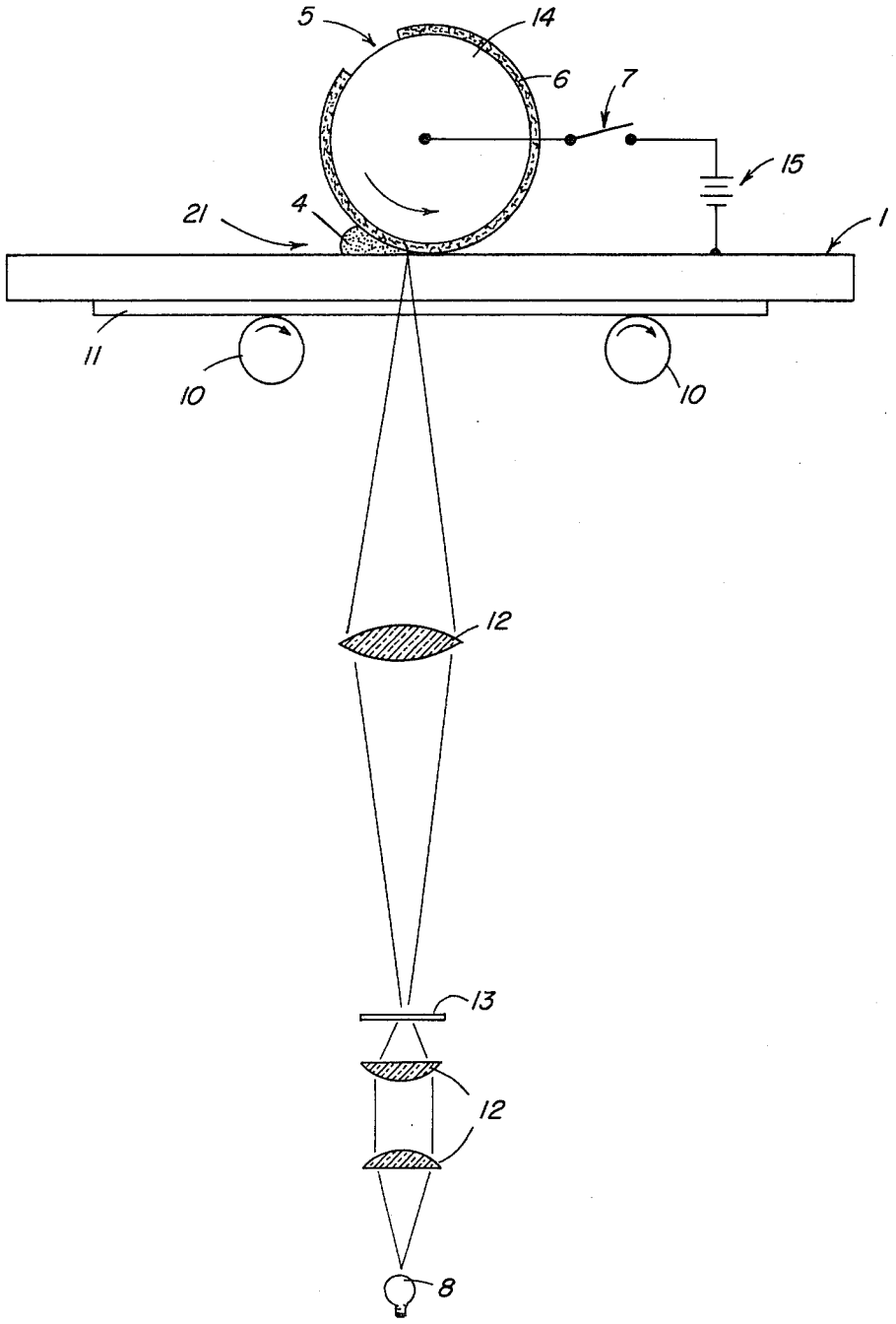

This invention relates to electrophoretic migration imaging dispersions and processes and, in particular, to chemical sensitizers useful therein.

BACKGROUND OF THE INVENTION

There is an extensive description in the patent and other technical literature of photoelectrophoretic migration imaging processes.

Typically, photoelectrophoretic migration imaging processes employ a layer of electrostatic charge-bearing photoconductive particles, i.e., electrically photosensitive particles, positioned between two spaced electrodes, one of which may be transparent. To achieve image formation the electrically photosensitive particles positioned between the two spaced electrodes are subjected to the influence of an electric field and exposed to an image pattern of activating radiation. The charge-bearing electrically photosensitive particles migrate electrophoretically to the surface of one or the other of the spaced electrodes. As a result an image pattern is formed on the electrode surfaces. Typically, a negative image is formed on one electrode, and a positive image is formed on the opposite electrode.

Image discrimination occurs in the photoelectrophoretic migration imaging processes as a result of a net change in charge polarity of either the exposed electrically photosensitive particles (in the case of conventional electrophoretic migration imaging) or the unexposed electrically photosensitive particles (in the case of the electrophoretic migration imaging process described in U.S. Pat. No. 3,976,485 to Groner). Hence the image formed on one electrode surface is composed ideally of electrically photosensitive particles of one charge polarity, either negative or positive polarity, and the image formed on the opposite polarity electrode surface is composed ideally of electrically photosensitive particles having the opposite charge polarity, either positive or negative.

An essential component of any photoelectrophoretic migration imaging process is the electrically photosensitive particles. Ideally such particles should possess useful levels of electrical photosensitivity and good colorant properties.

Some particles which exhibit good colorant properties do not possess useful levels of electrical photosensitivity. Means for increasing the level of electrical photosensitivity of such particles are therefore desirable. Sensitizers for electrically photosensitive particles have been described in patents. For example British Patent Specification No. 1,193,276 states that in general such particles may be sensitized by the addition of Lewis acids or Lewis bases. This statement is not very useful however. Relative to any selected electrophotosensitive particle, there are many Lewis acids and many Lewis bases which will not sensitize the selected particle. Moreover, this kind of statement does not take into account the many variables affecting sensitization resulting from the electrophoretic migration imaging dispersion in which a potential sensitizer is included.

The phrase "electrically photosensitive pigment" as used herein refers to any pigment which, when placed between two electrodes, subjected to an applied electric field and exposed to radiation which said pigment absorbs, will migrate to one of the two electrodes.

SUMMARY OF THE INVENTION

The present invention provides an electrophoretic migration imaging dispersion comprising an electrically insulating carrier, an electron accepting electrically photosensitive pigment, a charge control agent if desired, and a sensitizing amount of a compound selected from the group consisting of (a) aromatic amines having a p-alkyl, p-alkoxy or p-alkoxycarbonyl substituent on the aromatic group, (b) aryl alkanes, isoalkanes, and cycloalkanes having at least two aryl groups with at least one aryl group having an amino substituent, (c) dialkylarylamines having a pyranylalkenyl, a quinolinylalkenyl, or an arylazo substituent in the aryl group, (d) a julolidine and (e) a isobenzofuran.

The term "electron accepting electrically photosensitive pigment" refers to those pigments which are capable of accepting a pair of electrons in their outer valence shell.

Alkyl, alkenyl, alkane and alkoxy refer to substituents having from 1 to 4 carbon atoms. Aryl refers to phenyl, napthyl and anthryl.

The present invention also provides a migration imaging process comprising the steps of:

placing the electrophoretic imaging dispersion provided by this invention between at least two electrodes;

subjecting said dispersion to an applied electric field;

exposing said dispersion to an image pattern of radiation to which said dispersion is photosensitive, thereby obtaining image formation on at least one of said electrodes.

When one or more of the above sensitizers are included in an electrophoretic migration imaging dispersion in sufficient amounts, said sensitizers cause an increase in the speed of electron accepting electrically photosensitive pigment(s) included in the dispersion. This increased speed results in electrophoretic migration images having, for a given exposure value, greater densities compared to the same unsensitized dispersion.

PREFERRED EMBODIMENT

In a preferred embodiment the present invention provides an electrophoretic migration imaging dispersion comprising an electrically insulating carrier, an electron accepting electrically photosensitive pigment, and a sensitizing amount of one or more compounds selected from the group consisting of (a) phenyl amines having p-alkoxy, p-alkyl or p-alkoxycarbonyl substituents on the phenyl group, (b) phenylalkanes, isoalkanes and cycloalkanes having at least two phenyl groups with at least one phenyl group having an amino substituent (c) dialkylphenylamino having a pyranylalkenyl, a 2-quinolinylalkenyl or an arylazo substituent on the phenyl group (d) a julolidine and (e) a isobenzofuran.

FIG. 1 represents, diagrammatically, a typical imaging apparatus for carrying out the electrophoretic migration imaging process of the invention.

Representative sensitizers of the present invention are presented in Table I.

TABLE I

| No. | Sensitizer |
|---|---|
| 1. | tri-p-tolylamine 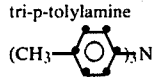 |

TABLE I-continued

| No. | Sensitizer |
|---|---|
| 2. | 4,4'-Bis-(4-diethylamino)tetraphenylmethane 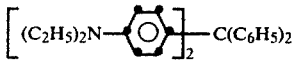 |
| 3. | 4,4',4''-trimethoxytriphenylamine 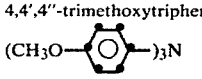 |
| 4. | 1,1-Bis(4-di-p-tolylaminophenyl)cyclohexane 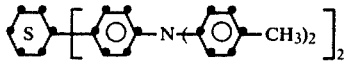 |
| 5. | N,N-dimethyl-N-p-(2-quinolinylethenyl)phenyl amine 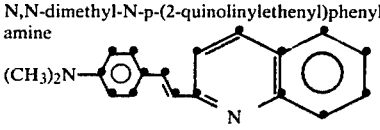 |
| 6. | N,N-dimethyl-N-(6-methyl-4-oxo-4(H)-2-pyranylethylphenyl)amine 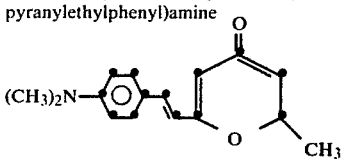 |
| 7. | julolidine 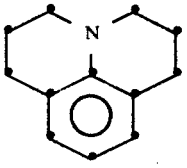 |
| 8. | N,N-diethyl-N-p-(N'-ethyl-N'-tolylamino)phenyl azophenyl amine 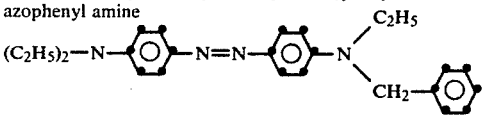 |
| 9. | N,N-diethyl-N-(6-methyl-4-oxo-4(H)-2pyranyl-ethenylphenyl)amine 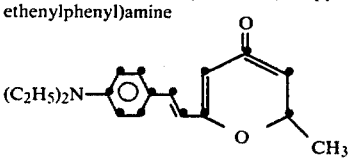 |
| 10. | methyl-N,N-p-ditolylaminohydrocinnamate 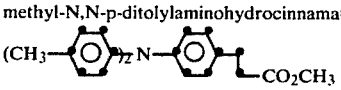 |
| 11. | 1,3-diphenylisobenzofuran 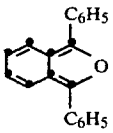 |
| 12. | 4,4'-bis(diethylamino)-2,2'-dimethyltri-phenylmethane 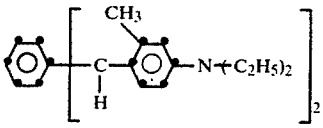 |

TABLE I-continued

| No. | Sensitizer |
|---|---|
| 13. | 1,1-Bis[-4-(N-ethyl-N-hydroxyethylamino)-2-methylphenyl]-isobutane 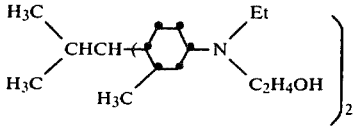 |
| 14. | 1,1-Bis[-4-(N-ethyl-N-hydroxyethylamino)phenyl] cyclohexane 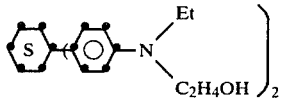 |
| 15. | 4,4'-Bis(N-ethyl-N-hydroxyethylamino)-2,2'-dimethyltriphenylmethane 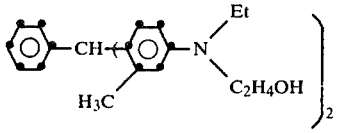 |

The electrophoretic migration imaging dispersions of the present invention are prepared by admixing on a weight to weight basis, (a) about 1 to about 10 weight percent of an electrically photosensitive pigment, (b) about 1 to about 10 weight percent of a stabilizer or charge control agent, if desired, and (c) about 90 weight percent of an electrically insulating carrier. This admixture can then be sensitized by adding thereto a sensitizing amount of an electrically insulating solution of the selected chemical sensitizers. Generally, the addition of about 0.0002 to about 0.1 weight percent of the selected sensitizer will be effective, although amounts outside of these ranges will also give useful results.

A variety of electron accepting electrically photosensitive pigments will be useful in the dispersions provided by the present invention. Appropriate pigments may be selected from the electrically photosensitive pigments disclosed in U.S. Pat. Nos. 2,758,939 by Sugarman, 2,940,847 by Kaprelian, and 3,384,488 and 3,615,558 by Tulagin et al, and U.S. Pat. No. 4,012,376 to Wright. Typical pigments include Cyan Blue GTNF, Sandorin Brilliant Red 5BL, Indofast Yellow, Copper phthalocyanine, zinc phthalocyanine, and epindolidione. Other useful pigments are disclosed in co-pending commonly assigned U.S. patent applications Nos. 818,689; 818,697; 818,698; 818,695 all filed July 25, 1977 by Webster et al.

The electrically insulating carriers useful in forming the dispersions provided by the present invention may assume a variety of physical forms and may be selected from a variety of different materials.

For example, the carrier material may be a matrix of an electrically insulating normally solid polymeric material capable of being softened or liquefied upon application of heat, solvent, and/or pressure so that the electrically photosensitive material dispersed therein can migrate through the carrier. The carrier may be a polymeric solution such as Piccotex 100 (vinyltoluene-methylstyrene copolymer) from Penn. Ind. Chem. Corp.) in Solvesso 100 or Isopar G solvent.

The carrier material can also comprise an electrically insulating liquid such as decane, paraffin, Sohio Odorless Solvent 3440 (a kerosene fraction marketed by the Standard Oil Company, Ohio), various isoparaffinic hydrocarbon liquids such as those sold under the trademark Isopar G by Exxon Corporation and having a boiling point in the range of 145° C. to 186° C., various halogenated hydrocarbons such as carbon tetrachloride, trichloromonofluoromethane, and the like, various alkylated aromatic hydrocarbon liquids such as the alkylated benzenes, for example, xylenes, and other alkylated aromatic hydrocarbons such as are described in U.S. Pat. No. 2,899,335.

An example of one such useful alkylated aromatic hydrocarbon liquid which is commercially available is Solvesso 100 made by Exxon Corp. Solvesso 100 has a boiling point in the range of about 157° C. to about 177° C. and is composed of 9 percent xylene, 16 percent of other monoalkyl benzenes, 34 percent dialkyl benzenes, 37 percent trialkyl benzenes, and 4 percent aliphatics.

Typically, whether solid or liquid at normal room temperatures of about 22° C., the electrically insulating carrier material used in the present invention is a material having a resistivity greater than about $10^9$ ohm-cms, preferably greater than about $10^{12}$ ohm-cms.

Various charge control agents or stabilizer materials may be added to the dispersions provided by the present invention to improve the uniformity of charge polarity of the electrically photosensitive material in liquid dispersions. These materials are typically polymeric materials incorporated by admixture thereof into the liquid carrier vehicle of the dispersion. In addition to, and possibly related to, the aforementioned enhancement of uniform charge polarity, it has been found that the charge control agents often provide more stable dispersions which exhibit substantially less settling out of the dispersed electrically photosensitive material.

Illustrative charge control agents include those disclosed in co-pending U.S. patent application No. 837,779 filed Sept. 29, 1977 by Stahly. The polymeric charge control agents disclosed therein comprise a copolymer having at least two different repeating units, (a) one of said units being present in an amount of at least about $0.5\times10^{-4}$ moles/gram of said copolymer and being derived from monomers selected from the group consisting of metal salts of sulfo acrylates and methacrylates and metal salts of acrylic and methacrylic acids, and (b) one of said repeating units being derived from monomers soluble in said carrier vehicle and present in an amount sufficient to render said copolymer dispersible in said carrier vehicle.

Examples of such copolymers are poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate), or poly(t-butylstyrene-co-lithium methacrylate).

The process of the present invention will be described in more detail with reference to the accompanying drawing, FIG. 1, which illustrates a typical apparatus which employs the electrophoretic migration imaging process of the invention.

FIG. 1 shows a transparent electrode 1 supported by two rubber drive rollers 10 capable of imparting a translating motion via test target 11 to electrode 1 in the direction of the arrow. Electrode 1 may be composed of a layer of optically transparent material, such as a glass or an electrically insulating, transparent polymeric support such as polyethylene terephthalate, covered with a thin, optically transparent, conductive layer such as tin oxide, indium oxide, nickel, and the like.

Optionally, depending upon the particular type of electrophoretic migration imaging process desired, the surface of electrode 1 may bear a "dark charge exchange" material, such as a solid solution of an electrically insulating polymer and 2, 4, 7, trinitro-9-fluorenone as described by Groner in U.S. Pat. No. 3,976,485 issued Aug. 24, 1976.

Spaced opposite electrode 1 and in pressure contact therewith is a second electrode 5, an idler roller which serves as a counter electrode to electrode 1 for producing the electric field used in the electrophoretic migration imaging process. Typically, electrode 5 has on the surface thereof a thin, electrically insulating layer 6.

Electrode 5 is connected to one side of the power source 15 by switch 7. The opposite side of the power source 15 is connected to electrode 1 so that as an exposure takes place, switch 7 is closed and an electric field is applied to the electrophoretic migration imaging dispersion 4 which is positioned between electrodes 1 and 5. The dispersion 4 may be positioned between electrodes 1 and 5 by applying dispersion 4 to either or both of the surfaces if electrode 1 and 5 prior to the imaging process or by injecting the dispersion 4 between the electrodes 1 and 5 during the photoelectrophoretic migration imaging process.

As shown in FIG. 1, exposure of dispersion 4 takes place by use of an exposure system consisting of light source 8, test target 11 to be reproduced, such as a photographic transparency, a lens system 12, and any necessary or desirable radiation filters 13, such as color filters, whereby dispersion 4 is irradiated with a pattern of activating radiation corresponding to test target 11.

Although the electrophoretic migration imaging device represented in FIG. 1 shows electrode 1 to be transparent to activating radiation from light source 8, it is possible to irradiate electrically photosensitive particulate material 4 in the nip 21 between electrodes 1 and 5 without either electrodes 1 or 5 being transparent. In such a system, although not shown in FIG. 1, the exposure source 8 and lens system 12 is arranged so that image material 4 is exposed in the nip or gap 21 between electrodes 1 and 5.

As shown in FIG. 1, electrode 5 is a roller electrode having a conductive core 14 connected to power source 15. The core is in turn covered with a layer of insulating material 6, for example, baryta paper. Insulating material 6 serves to prevent or at least substantially reduce the capability of the electrically photosensitive pigments in dispersion 4 to undergo a radiation induced charge alteration upon interaction with electrode 5. Hence, the term "blocking electrode" may be used, as is conventional in the art of electrophoretic migration imaging, to refer to electrode 5.

Although electrode 5 is shown as a roller electrode and electrode 1 is shown as essentially a translatable, flat plate electrode in FIG. 1, either or both of these electrodes may assume a variety of different shapes such as a web electrode, rotating drum electrode, plate electrode, and the like as is well known in the field of electrophoretic migration imaging.

In general, during a typical electrophoretic migration imaging process wherein dispersion 4 comprises an electrically insulating liquid carrier, electrodes 1 and 5 are spaced such that they are in pressure contact or very close to one another during the electrophoretic migration imaging process. Typical separation between electrodes is 1–50μ.

The strength of the electric field imposed between electrodes 1 and 5 during the photoelectrophoretic migration imaging process of the present invention may vary considerably. However, it has generally been found that optimum image density and resolution are obtained by increasing the field strength to as high a level as possible without causing electrical breakdown within the system.

As explained hereinabove, image formation occurs in electrophoretic migration imaging processes as the result of the combined action of activating radiation and electric field on the electrically photosensitive particulate material 4 disposed between electrodes 1 and 5. Typically, for best results, field application and exposure to activating radiation occur concurrently. However, as would be expected, by appropriate selection of various process parameters such as field stength, activating radiation intensity, incorporation of suitable light sensitive addenda in or together with the electrically photosensitive particles used in the present invention, it is possible to alter the timing of the exposure and field application events so that one may use sequential exposure and field application events rather than concurrent field application and exposure events.

Subsequent to the application of the electric field and exposure to activating radiation, the images which are formed on the surface of electrodes 1 and/or 5 of the apparatus shown in FIG. 1 may be temporarily or permanently fixed to these electrodes or may be transferred to a final image receiving element.

Fixing of the final particle image can be effected by various techniques, for example, by applying a resinous coating over the surface of the image bearing substrate. For example, if electrically photosensitive particles 4 are dispersed in a liquid carrier between electrodes 1 and 5, one may fix the image or images formed on the surface of electrodes 1 and/or 5 by incorporating a polymeric binder material in the carrier liquid. Many such binders (which are well known for use in liquid electrophotographic liquid developers) are known to acquire a charge polarity upon being admixed in a carier liquid and therefore will, themselves, electrophoretically migrate to the surface of one or the other of the electrodes.

Alternatively, a coating of a resinous binder (which has been admixed in the carrier liquid), may be formed on the surfaces of electrodes 1 and/or 5 upon evaporation of the liquid carrier.

Polychrome images may also be formed from admixtures made up of electrically photosensitive particles of different hues. One example of such a mixture contains cyan, yellow and magenta electrically photosensitive particles of the present invention. When such an admixture of multicolored electrically photosensitive composite particles is formed, for example, in an electically insulating carrier liquid, this liquid mixture of particles exhibits a black coloration.

Preferably, the specific cyan, magenta, and yellow particles selected for use are chosen so that their spectral response curves do not appreciably overlap whereby color separation and subtractive multicolor image reproduction can be achieved in polychrome imaging.

The following examples illustrate the invention, the parts and percentages being by weight unless otherwise stated.

EXAMPLES

Image Evaluation Apparatus

An image evaluation apparatus was used in each of the succeeding examples to carry out the electrophoretic migration imaging process described herein. This apparatus was a device of the type illustrated in FIG. 1.

In this apparatus, a translating NESATRON (trademarks of PPG for a conductive tin oxide treated glass or a conductive indium oxide sputtered glass, respectively) glass plate served as electrode 1 and was in pressure contact with a 10 centimeter diameter aluminum roller 14 covered with a thin insulating layer of poly(vinyl butyral)-$TiO_2$ coated paper 6 which served as electrode 5. NESATRON plate 1 was supported by two 2.8 cm. diameter rubber drive rollers 10 positioned beneath NESATRON plate 1 such that a 2.5 cm. opening, symmetric with the axis of the aluminum roller 14, existed to allow exposure exposure of electrically photosensitive particles 4 to activating radiation.

The original transparency 11 to be reproduced was taped to the back side of NESATRON plate 1.

The exposing activating radiation was supplied from a light source 8 consisting of a Kodak Carousel projector and had a maximum intensity of 3500 footcandles at the NESATRON glass plate exposure plane.

The voltage between the electrode 5 and NESATRON plate 1 was variable up to 10 kilovolts. However, most tests were made in the 0.5 to 2 kv range.

NESATRON plate 1 was negative polarity.

The translational speed of NESATRON plate 1 was variable between about 1.25 cm. and about 30 cm. per second.

In the following examples, image formation occurs on the surfaces of NESATRON glass plate 1 and electrode 5 after simultaneous application of light exposure and electric field to electrically photosensitive particulate material 4.

Each different type of material to be evaluated for use as electrically photosensitive particulate material 4 was admixed with a liquid carrier as described below to form a liquid imaging dispersion which was placed in nip 21 between the electrodes 1 and 5. If the material being evaluated for use as material 4 possessed a useful level of electrical photosensitivity, one obtained a negative-appearing image reproduction of original 11 on electrode 5 and a complementary image on electrode 1.

EXAMPLES 1–15

These examples show the sensitizing effect of 15 materials from Table I when such materials are added to migration imaging dispersions.

Cyan, Magenta and Yellow dispersions were prepared using Cyan Blue GTNF, Sandorin Brilliant Red 5BL, and Indofast Yellow as the electrically photosensitive pigments. These dispersions were prepared by ball-milling the pigments at high concentration with a polymeric charge control agent and then diluting the resultant mixture with another polymer solution. The exact rations of the various materials used in the initial high concentration ball-mill concentrate and subsequent polymer solution are outlined below:

Ball-mill concentrate 1 gram of pigment 1 gram of polymeric charge control agent polyvinyltoluene-co-lauryl methacrylate-co-lithium methacrylate-co-methacrylic acid PVT) 56/40/3.6/0.4
110 grams of stainless steel balls having a diameter of about 3mm, and
12.2 grams of carrier liquid consisting of Solvesso 100 (purchased from the Exxon Corporation).

Each of the ball-mill concentrates having the above-noted composition were ball-milled in a 125 milliliter glass jar at 115 revolutions per minute for at least one week. The ball-mill concentrates were then diluted by adding 35.8 grams of a 40% by weight solution of Piccotex 100 (vinyltoluene-methylstyrene copolymer from Penn. Inc. Chem. Corp.) in Solvesso 100 or Isopar G solvent. The resulting diluted imaging dispersion was ball-milled for at least one day.

All of the Table I pigments were dissolved in Solvesso 100 to form 15 different solutions. Each was tested for sensitization in one or more of the above migration imaging dispersions. The tests were conducted on an apparatus of the type described in FIG. 1 under the following imaging conditions.

Light intensity: 2000 foot candles modified by a Kodak Wratten 2A filter and a 665 nm interference cutoff filter.
Electrode potential: −1500 volts on NESATRON glass plate.
Plate translational speed: 23 cm/sec for cyan and 15 cm/sec for magenta.

The test pattern used for testing these dispersions consisted of adjacent red, green, and blue filters (Kodak Wratten 29, 61 and 47 filters, respectively) each superimposed with a 0.3 neutral density step wedge.

To evaluate the speed increase due to the presence of a sensitizer, the light intensity needed to produce a mid-range print reflection density resulting from a color exposure complementary to the dispersion's color was compared to the intensity needed to produce the same reflection density with a control dispersion containing no sensitizer. For an example, the relative red light intensities necessary to produce the same mid-range red, print reflection density were compared for the sensitized and unsensitized cyan dispersions and the speed increase calculated. The print density for the other color exposures corresponding to unwanted absorptions was measured in the same manner. The ratios of the speed increase for the sensitized and unsensitized control were calculated. Test results are set out in Table II. These results show that the sensitizers of the present invention increase the speed of the listed pigments from 3 to 16 times the speed of the pigment alone.

TABLE II

| Example No. | Table I Material | Sensitizer Concentration in Dispersion (% by weight) | Relative Speed Increase* Magenta | Cyan | Yellow |
|---|---|---|---|---|---|
| 1 | 1 | 0.4 | 8 | 4 | 4 |
| 2 | 2 | 0.4 | 16 | 6 | 2 |
| 3 | 3 | 0.002 | 8 | — | — |
| 4 | 4 | 0.1 | 8 | 4 | — |
| 5 | 5 | 0.04 | 4 | — | — |
| 6 | 6 | 0.04 | 3 | — | — |
| 7 | 7 | 0.1 | 16 | 4 | — |
| 8 | 8 | 0.1 | 16 | 10 | — |
| 9 | 9 | 0.04 | 4 | — | — |
| 10 | 10 | 0.1 | 4 | 2 | — |
| 11 | 11 | 0.1 | 4 | 2 | — |

TABLE II-continued

| Example No. | Table I Material | Sensitizer Concentration in Dispersion (% by weight) | Relative Speed Increase* Magenta | Cyan | Yellow |
|---|---|---|---|---|---|
| 12 | 12 | 0.04 | 9 | 4 | — |
| 13 | 13 | 0.04 | 10 | 4 | — |
| 14 | 14 | 0.04 | 4 | 4 | — |
| 15 | 15 | 0.04 | 8 | 4 | — |

*The symbol "—" indicates that no measurements were made with the particular sensitizer-pigment combination in question.

EXAMPLE 16

To demonstrate the unexpected nature of the present invention, compounds outside the scope of the present invention but which include some structural similarities to the sensitizers of the present invention were also tested. These materials did not sensitize dispersions prepared as in Examples 1-15. These materials had the following structures:

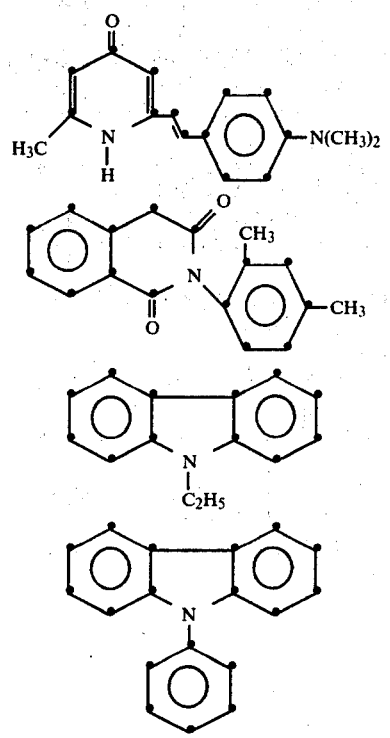

In the foregoing examples:

Cyan Blue GTNF is the beta form of copper phthalocyanine, from American Cyanamid.

Sandorin Brilliant Red 5BL is a quinacridone pigment from Sandoz Corporation.

Indofast Yellow is a flavanthrone pigment, C.I. No. 70600 from Harmon Colors Company.

Lexan 145 is a Bisphenol-A polycarbonate from General Electric Company.

This invention has been described in detail with particular reference to certain preferred embodiments thereof, but it will be understood that variations and modifications can be effected within the spirit and scope of the invention.

We claim:

1. An electrophoretic migration imaging dispersion comprising an electrically insulating carrier, an electron accepting electrically photosensitive pigment, and a sensitizing amount of one or more compounds selected from the group consisting of (a) aromatic amines having a p-alkyl, p-alkoxy or p-alkoxycarbonyl substituent on the aromatic group, (b) aryl alkanes, isoalkanes and cycloalkanes having at least two aryl groups with at least one aryl group having an amino substituent, (c) dialkylarylamines having a pyranylalkenyl, a quinolinylalkenyl or an arylazo substituent on the aryl group, (d) a julolidine and (e) a isobenzofuran.

2. An electrophoretic migration imaging dispersion comprising an electrically insulating carrier, an electron accepting electrically photosensitive pigment, and a sensitizing amount of one or more compounds selected from the group consisting of (a) phenyl amines having p-alkoxy, p-alkyl or alkoxycarbonyl substituents on the phenyl group, (b) phenylalkanes, isoalkanes, and cycloalkanes having at least two phenyl groups with at least one phenyl group having an amino substituent, (c) dialkylphenylamine having a pyranylalkenyl, a 2-quinolinylalkenyl or a arylazo substituent on the phenyl group, (d) julolidine and substituted julolidines, isobenzofuran and substituted isobenzofurans.

3. An electrophoretic migration imaging dispersion as in claim 2, which includes a sensitizing amount of one or more compounds selected from the group consisting of tri-p-tolylamine;
4,4'[Bis-(4-diethylamino)tetraphenylmethane;
4,4',4''-trimethoxytriphenylamine;
1,1-Bis(4-di-p-tolylaminophenyl)cyclohexane;
N,N-dimethyl-N-p-(2-quinolinylethenyl)phenylamine;
N,N-dimethyl-N-(6-methyl-4-oxo-4(H)-2-pyranylethenylphenyl)amine;
julolidine;
N,N-diethyl-N-p-(N'-ethyl-N'-tolylamino)phenyl azophenyl amine;
N,N-diethyl-N-(6-methyl-4-oxo-4(H)-2-pyranylethenylphenyl)amine;
methyl-N,N-p-ditolylaminohydrocinnamate;
1,3-diphenylisobenzofuran;
4,4'-bis(diethylamino)-2,2'-dimethyltriphenylmethane;
1,1-Bis[-4-(N-ethyl-N-hydroxyethylamino)-2-methylphenyl]-isobutane;
1,1-Bis[4-(N-ethyl-N-hydroxyethylamino)phenyl]-cyclohexane; and
4,4'-Bis-(N-ethyl-N-hydroxyethylamino)-2,2'-dimethyltriphenylmethane.

4. A dispersion as in claims 1 2, or 3, wherein said sensitizer is present in said dispersion in amounts ranging from about 0.0002% to about 0.1% weight percent.

5. A dispersion as in claims 1, 2 or 3, which contains from about 1.0 to about 10 weight percent of a charge control agent.

6. A dispersion as in claims 1, 2 or 3, which contains from about 1.0 to about 10 weight percent of the pigment.

7. A dispersion as in claims 1, 2, or 3, wherein the carrier is a liquid.

8. A dispersion as in claim 1, 2 or 3, wherein the pigment is selected from the group consisting of Cyan Blue GTNF, Sandorin Brilliant Red 5BL. Indofast Yellow, Copper phthalocyanine, zinc, phthalocyanine, and epindolidione.

9. In an electrophoretic migration imaging process comprising the steps of:

placing an electrophoretic migration dispersion between at least two electrodes wherein said dispersion comprises an electrically insulating carrier, an electron accepting pigment and a sensitizer;

subjecting said dispersion to an applied electric field; and exposing said dispersion to an image pattern of radiation to which said dispersion is photosensitive, thereby forming image formation on at least one of said electrodes, the improvement wherein said sensitizer is selected from the group consisting of (a) aromatic amines having a p-alkyl, p-alkoxy or p-alkoxycarbonyl substituent on the aromatic group, (b) aryl alkanes, isoalkanes, and cycloalkanes having at least two aryl groups with at least one aryl group having an amino substituent, (c) dialkylarylamines having a pyranylalkenyl, a quinolinylalkenyl or a arylazo substituent on the aryl group, (d) a julolidine and (e) a isobenzofuran.

* * * * *